US006935415B1

(12) United States Patent
Petersen et al.

(10) Patent No.: US 6,935,415 B1
(45) Date of Patent: Aug. 30, 2005

(54) HEAT EXCHANGER PLATE AND SUCH A PLATE WITH A GASKET

(75) Inventors: Jes H. Petersen, Lunderskov (DK); Benny Jensen, Kolding (DK)

(73) Assignee: APV Heat Exchanger A/S, (DK)

( * ) Notice: Subject to any disclaimer, the term of this patent is extended or adjusted under 35 U.S.C. 154(b) by 85 days.

(21) Appl. No.: 10/018,670

(22) PCT Filed: Jun. 14, 2000

(86) PCT No.: PCT/DK00/00319

§ 371 (c)(1),
(2), (4) Date: Feb. 27, 2002

(87) PCT Pub. No.: WO00/77468

PCT Pub. Date: Dec. 21, 2000

(30) Foreign Application Priority Data

Jun. 14, 1999 (DK) ..... 1999 00838

(51) Int. Cl.[7] ..... F28F 3/00
(52) U.S. Cl. ..... 165/166
(58) Field of Search ..... 165/166, 167

(56) References Cited

U.S. PATENT DOCUMENTS

| | | | | |
|---|---|---|---|---|
| 4,377,204 A | | 3/1983 | Johansson | |
| 4,432,415 A | | 2/1984 | Wright | |
| 4,635,715 A | | 1/1987 | Andersson | |
| 4,905,758 A | | 3/1990 | Mathur et al. | |
| 4,995,455 A | | 2/1991 | Mathur | |
| 5,070,939 A | | 12/1991 | Mathur | |
| 5,988,268 A | | 11/1999 | Usami et al. | |
| 6,073,687 A | * | 6/2000 | Jensen et al. | 165/166 |
| 6,186,224 B1 | * | 2/2001 | Seidel | 165/166 |

FOREIGN PATENT DOCUMENTS

| | | |
|---|---|---|
| EP | 0 752 570 A1 | 1/1997 |
| GB | 2 028 996 A | 3/1980 |
| GB | 2 075 656 A | 11/1981 |
| GB | 2 117 890 A | 10/1983 |
| GB | 2 138 931 A | 10/1984 |
| GB | 2 189 590 A | 10/1987 |
| JP | 51-33392 | 8/1976 |
| JP | 52-130048 A | 11/1977 |
| SU | 1430716 A1 | 10/1988 |
| WO | WO 87/01189 A1 | 2/1987 |

* cited by examiner

*Primary Examiner*—Ljiljana Ciric
(74) *Attorney, Agent, or Firm*—Leydig, Voit & Mayer, Ltd.

(57) ABSTRACT

A heat exchanger plate includes a gasket groove that extends through a portion of the plate proximate to the periphery of the plate. The groove includes spaced expanded portions disposed to receive a plurality of coupling elements formed on an associated gasket. The expanded portions include tongue-like ridged portions with openings substantially perpendicular to the longitudinal direction of the gasket groove that are configured to receive the gasket coupling elements.

20 Claims, 3 Drawing Sheets

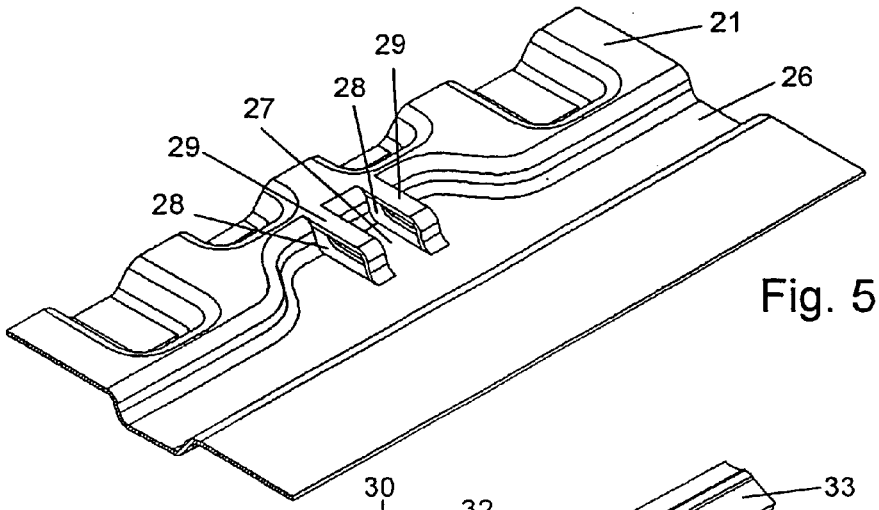
Fig. 5
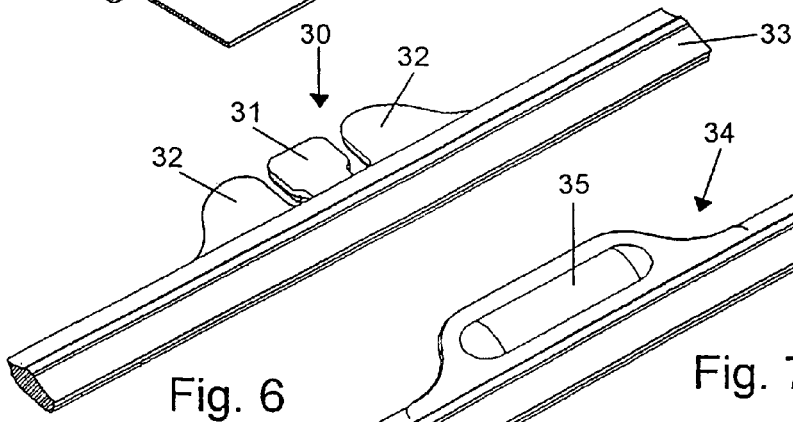
Fig. 6
Fig. 7
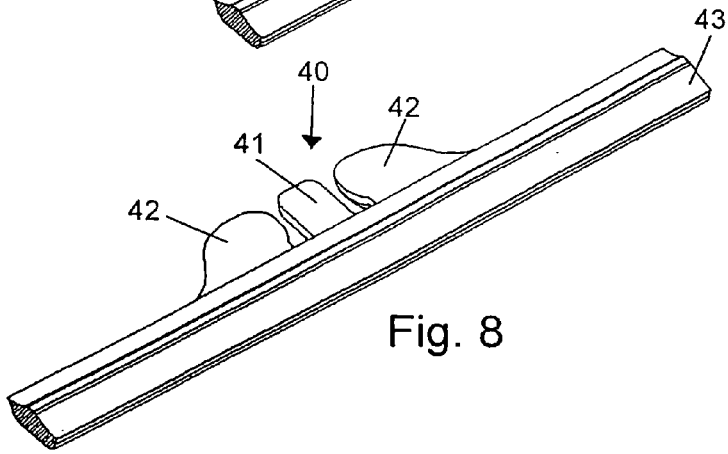
Fig. 8

HEAT EXCHANGER PLATE AND SUCH A PLATE WITH A GASKET

The invention relates to a plate for a plate-type heat exchanger.

Plate-type heat exchangers are constructed of a number of plates separated by gaskets. In general, each plate has a rectangular configuration and at each corner it is provided with inlet and outlet openings for two heat exchanger media. The plate is ridged into a corrugated pattern and provided with a gasket that will, when the plate-type heat exchanger is assembled, abut on the next plate in the stack. The gasket defines a flow area that is in contact with two of the corner openings and therefore allows flow of a first heat exchanger medium to this side of the plate. The two remaining corner openings are cut off by the gasket. The subsequent heat, exchanger plate in the stack has been rotated 180°, and thus its gasket defines a flow area that is in contact with the two other corner openings on the opposite side of the first plate and permits flow of another heat exchanger medium on this side of the plate. By rotating every other heat exchanger plate 180° a plate-type heat exchanger is constructed wherein every other space is flushed by the first heat exchanger medium whereas the remaining spaces are flushed by tile other heat exchanger medium.

Generally, every heat exchanger plate is provided with a gasket groove wherein a gasket that is preferably made of rubber can be arranged. In order to facilitate assembly of the plate-type heat exchanger, the gasket is secured in the gasket groove and this can be accomplished in a variety of ways. Conventionally the gasket is glued into the gasket groove, but in view of the fact that this causes a problem in connection with a subsequent disassembly of the plate-type heat exchanger, alternative mechanical attachment methods have been developed.

Such mechanical attachment methods can be divided into two groups. In the first group the attachment is accomplished in that the gasket is provided with a protruding portion that can engage with an opening provided in connection with the gasket groove. The opening can be a punched opening (eg as shown in U.S. Pat. No. 4,377,204) or it may be formed by cutting and ridging of plate material whereby an opening is formed without removal of material (eg as shown in U.S. Pat. No. 4,905,758). In the other group the gasket and the gasket groove are configured such that the gasket extends beyond the edge of the heat exchanger plate and is secured there by means of flaps that seize around the edge (eg as shown in EP 0 762 071).

The present invention relates to the group of attachment methods wherein openings are provided by cutting and ridging of plate material as shown in U.S. Pat. No. 4,905, 758, This method presents a number of advantages compared to the other methods mentioned.

The method in which an opening is punched into the heat exchanger plate near the gasket groove is associated with the drawback that the punching of the opening—or in reality the many holes that are spaced apart along the gasket groove—presupposes either a separate series of operation following ridging of the plate, or it presupposes that the ridging tool is also provided with punching tools which significantly increases the cost of such tool. Besides, the latter solution is undesirable since there will be a risk that punched-out parts remain in the ridging tool and is thereby detrimental to the subsequent ridging/punching process.

Cutting and ridging of material to form the opening can be accomplished in the same operation procedure as the ridging of the plate itself, and thus no separate operation procedure is required and, likewise, the demands to the large tolerances of the cutting tool are not high, and it can therefore relatively inexpensively be incorporated in the ridging tool.

In the methods where the gasket and the gasket groove are configured such that the gasket extends beyond the periphery of the heat exchanger plate and is secured there by means of flaps that engage around the edge, a complex configuration of the gasket is necessary which, on the one hand, increases the cost of manufacture of such gasket and, on the other, renders the mounting of the gasket cumbersome and time-consuming.

A gasket for mounting in openings formed by cutting and ridging of material may have a simple configuration and is comparatively readily mounted in the gasket groove.

U.S. Pat. No. 4,905,758 teaches a heat exchanger plate with a gasket groove provided, at intervals, with an expanded portion that is situated in the same plane as the gasket groove itself, and which is therefore pressed down relative to the surrounding gasket material. By the pressing-down the ends of the expanded portion have been cut open, whereby openings are formed there in a plane located substantially perpendicular to the longitudinal direction of the gasket groove.

The gasket is provided with protruding coupling elements that fit into the expanded portions of the gasket groove, their configuration being such that they are able to engage with the openings that are provided at each end of the expanded portions.

Securing of the gasket is accomplished in that the ends of the expanded coupling element of the gasket are pressed into the openings, which means that the holding force is determined by the engagement between the expanded portion of the gasket and primarily the upper edge 1 of the openings.

It has been found that in the manufacture of heat exchanger plates with a configuration that corresponds to the one shown in U.S. Pat. No. 4,905,759, it is difficult to observe the requisite tolerances on the distance between the two upper edges of the openings, the plate material contracting when the initially plane plate is pressed upwards to the desired profiled shape. The extent of the contraction depends in part on the ridging of the surrounding material, in part on the plate material and in part on the plate thickness. The distance between the two upper edges can thus vary from plate to plate and from coupling site to coupling site along the gasket groove, with an ensuing undesirable variation in the holding force between the expanded portion of the gasket groove and the coupling element of the gasket such irregular holding force may give rise to problems during assembly of a plate-type heat exchanger since a gasket may unintentionally be displaced out of the gasket groove in case it is not sufficiently attached.

It is the object of the present invention to provide a heat exchanger plate of the above-mentioned type, wherein the distance between the edges with which the gasket engages can be manufactured within narrow tolerances so as to overcome the above-mentioned drawbacks.

This is obtained by configuring the plate mentioned above as featured in the characterising part of claim 1.

Hereby a heat exchanger plate is obtained wherein the expanded portion features securing openings to each side of the ridged, tongue-like portion(s), and the distance between the openings formed can be kept within narrow tolerances, the ridged, tongue-like portion(s) not being influenced by the contraction pattern of the surrounding material as such during manufacture of the plate. Such configuration of the heat exchanger plate thus enables that all the mutually spaced expanded portions feature securing openings, whose mutual distance is kept within the same narrow tolerances independently of the ridging as such and of the plate material and thickness. Besides, this also means that the same ridging tool can be used in the manufacture of heat exchanger plates made of different materials and having different thicknesses. Since the coupling elements of the gasket that are configured for engaging with these tolerances can also be manufactured within narrow tolerances, it is possible to obtain a homogenous holding force throughout the space between the plate and the gasket.

According to a first embodiment of the invention, one ridged, tongue-like portion is provided centrally in the expanded portion, and the coupling element of the gasket comprises two protruding parts that are configured to engage with the openings provided at each side of the tongue-like portion. This embodiment constitutes the simplest configuration of a heat exchanger plate in accordance with the invention.

According to an alternative embodiment of the invention two ridged, tongue-like portions are provided at a distance from each other in the expanded portion. In this embodiment there is provided four attachment openings, viz one on each side of the two tongue-like portions. Therefore the coupling element of the gasket can be manufactured in a variety of ways, as it may be configured with protruding flaps that engage with different openings. Thus, the coupling element of the gasket may comprise a protruding flap configured to engage with the two middle and mutually facing openings provided at each their tongue-like portion, or it may comprise two protruding flaps that are configured for engaging with the two mutually most distant openings provided at each their tongue-like portion. Thus the gasket can be configured with an engagement flap that is clamped between the tongue-like portions or with engagement flaps that clamp around the two tongue-like portions.

The flaps on the couplings elements of the gasket can be configured such that they extend partially into the openings, or they can be configured such that they press on the openings without extending considerably there into, depending on how much holding force is desired.

Finally the coupling element of the gasket can be provided with a pressure element arranged above the coupling element as such, said pressure element not interfering with the functionality of the coupling element of the gasket, but facilitating the mounting of the gasket on the plate.

The invention will now be explained in further detail with reference to the drawing, wherein FIG. 1 shows a heat exchanger plate according to the invention provided with a gasket;

FIG. 5 is an enlarged view of a section of the embodiment of a heat exchanger plate according to an alternative embodiment of the invention; and FIGS. 6–8 show parts of a gasket that can be mounted in the heat exchanger plate shown in FIG. 5.

Figure 1:
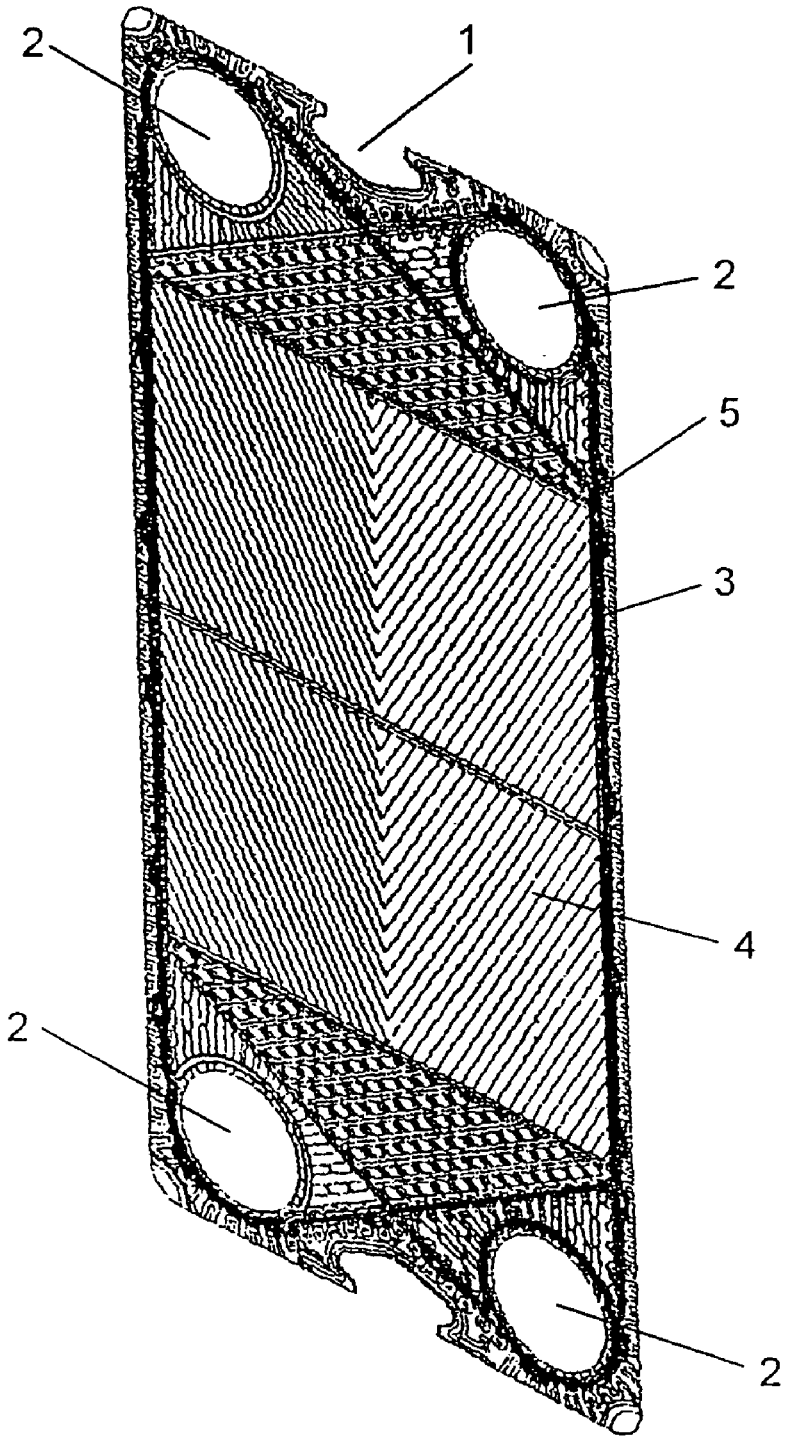

FIG. 1 shows a rectangular heat exchanger plate 1 with corner openings 2 for the heat exchanger media. The plate 1 is provided with a gasket 3 that defines a flow area 4 for the one heat exchanger medium, it being in communication with two of the corner openings 2. The remaining two corner openings 2 are cut off by the gasket 3. Preferably the plate 1 is configured with a corrugated surface as shown since, on the one hand, it increases the heat exchange across the plate 1 and, on the other, imparts rigidity to the plate 1. The corrugations are accomplished by ridging in a pressing tool. When a heat exchanger is assembled every other plate 1 with gasket 3 is rotated 180° such that the one heat exchanger medium flows between every other plate, whereas the other flows between the remaining plates. This is a completely conventional construction of a heat exchanger.

In order to facilitate mounting of the plate-type heat exchanger, the gasket 3 is attached to the plate 1. To this end, the gasket 3 is provided with expanded portions 5 evenly distributed around the gasket. The plate 1 is configured with cut-outs that are complementary with the expanded portions of the gasket 3 whereby the gasket 3 can be secured by means of these cut-outs in the plate 1.

Figure 2:
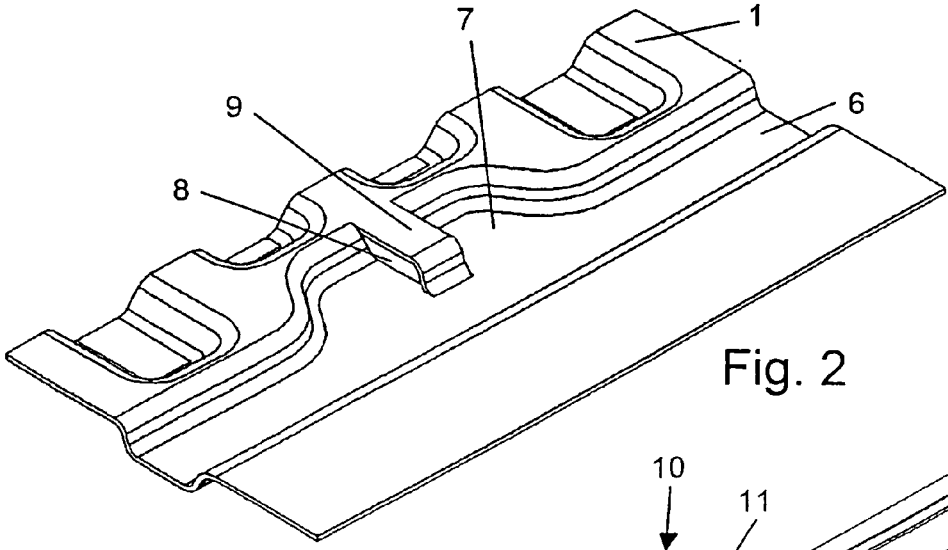
FIG. 2 is an enlarged view of a section of the embodiment of a heat exchanger plate according to a first embodiment of the invention.

FIG. 2 is an enlarged-scale view of a portion of the heat exchanger plate 1 according to a first embodiment of the invention.

As will appear the plate 1 is provided with a gasket groove 6 for receiving a gasket 3. The gasket groove 6 is provided with mutually spaced expanded portions 7 that are complementary with corresponding expanded portions on the gasket 3. Centrally in the expanded portion 7, an opening 8 is provided that is accomplished by the ridging of the plate 1. In this pressing operation the corrugated surface of the plate 1 and the gasket groove 6 with the expanded portion 7 are provided. Simultaneously the opening 8 is formed, the two parts of the pressing tool pressing a tongue-like portion 9 upwards in relation to the gasket groove 6 and the expanded portion 7. In the operation, two slits are cut in the plate 1, but no material is removed.

The opening 8 co-operates with a corresponding opening at the opposite side of the tongue 9 to form the coupling means of the plate 1 for a gasket, wherein the upper edge of the opening 8 will, following interconnecting, retain an engaging part on the expanded portion of a gasket as will be described below. The width of the tongue 9 is well-defined, and the plate material of which it consists is essentially not exposed to further tensions or contractions by the ridging which means that the distance between the upper edges of the two engaging openings 8 is accurately determined within narrow tolerances.

Figure 3:
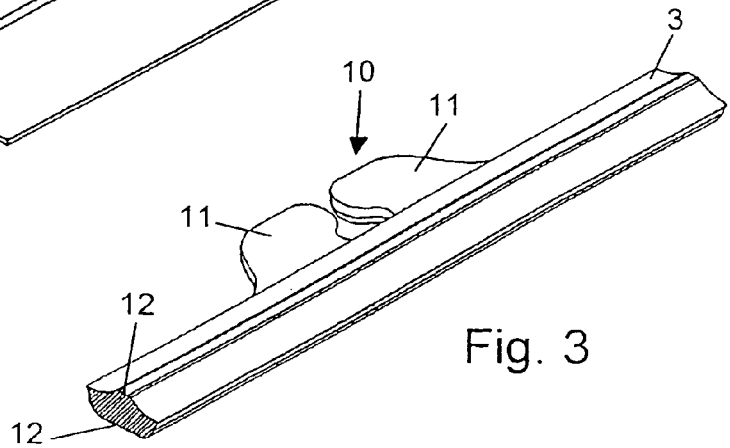
FIG. 3 shows a part of a gasket that can be mounted in the heat exchanger plate shown in FIG. 2.

FIG. 3 shows a part of a gasket 3 that matches the gasket groove 6 in the sheet 1 shown in FIG. 2. At intervals, the gasket 3 is provided with coupling elements 10 that consist—in the embodiment shown—of two protruding flaps 11. The configuration of the gasket 3 and the protruding tongues 11 corresponds with a high degree of accuracy to the configuration of the gasket groove 6 and the expanded portion 7 thereof. The flaps 11 are configured such that the parts thereof that face each other are able to snap-lockingly engage with the openings 8 in the plate 1.

Preferably the gasket is made of rubber, but it may also be made of other material. On its top and bottom faces, the gasket 3 can also be provided with sealing lips 12 as shown to accomplish improved sealing between the heat exchanger plates when assembled to form a plate-type heat exchanger.

Figure 4:
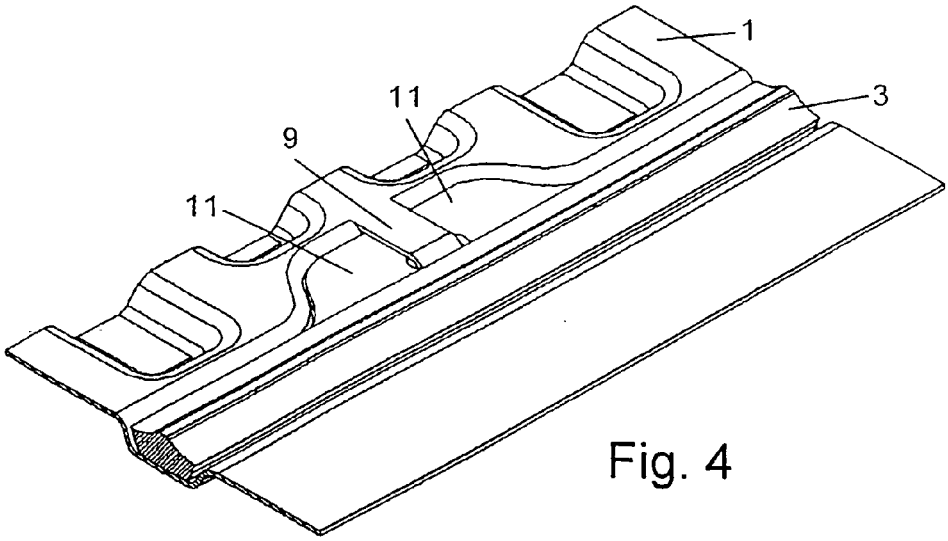
FIG. 4 shows the gasket shown in FIG. 3 mounted in the heat exchanger plate shown in FIG. 2.

FIG. 4 shows the gasket 3 illustrated in FIG. 3 mounted in the heat exchanger shown in FIG. 2. As will appear from the dash-dotted lines, part of the flaps 11 on the gasket 3 extend into the openings 8 on the plate 1. Preferably the flaps 11 snap into the openings 8, but the attachment can also be accomplished by a purely clamping effect wherein the soft material of the gasket 3 thus merely squeezes around the openings 8. As mentioned previously the openings 8 can feature burrs as a result of the cutting and ridging procedures. Following mounting of the gasket 3, such burrs can engage with the rubber material and thus contribute to further securing the gasket 3.

FIG. 5 shows an alternative embodiment of a heat exchanger plate 21 in accordance with the invention.

Again, the plate 21 is provided with a gasket groove 26 having an expanded portion 27. In this embodiment the expanded portion 7 is provided by ridging of material from the gasket groove 6 in such a manner that two identical, tongue-like portions 29 are formed, each of which corresponds substantially to the tongue 9 in the embodiment shown in FIG. 2. The upper edges of both tongues 29 being free, they are not influenced by the remaining plate elements of the plate 21 and their contractions, if any, during manufacture of the plate 21, with the result that the mutual distances between the openings formed 28—of which there is a total of four, two for each tongue 29—are determined accurately within narrow limits.

The formation of two tongues 29 rather than one means that there are more options with regard to the configuration of the associated gasket, of which three are shown in FIGS. 6–8.

FIG. 6 shows a gasket 33 provided with a coupling element 30 in the form of a centrally protruding coupling flap 31 and two external flaps 32. The central coupling flap 31 has a width that, in general, slightly exceeds the distance between the two ridged tongues 29 in the expanded portion 27 of the plate 21, whereby it can be clamped tightly between the openings 28 of the two tongues 29. The external flaps 32 are configured to be complementary with the outermost areas of the expanded portion 27 of the plate 21, whereby the gasket 33 fills the entire expanded portion 27 when mounted. In this embodiment, the external flaps 32 as such do not contribute to securing the gasket 33 in the gasket groove 26 and, as it is, they might as well be omitted.

The mounting of the gasket 33 is accomplished by arranging same in the gasket groove 26 and pressing the central coupling flap 31 down between the two tongues 29 whereby it snaps into the openings 28 of the tongues 29 and is secured herein below the upper edges of the tongues 29.

In order to facilitate mounting the gasket 33 can, as shown in FIG. 7, be provided with a pressure element 34 arranged above the coupling element 30 of the gasket 33 that has been shown in dashed lines. The pressure element 34 is coherent with the central coupling flap 31 and the external flaps 32 without, however, the functionality of the central flap 31 being influenced. On its top face the pressure element 34 is provided with a pressure cushion 35 in the form of an upwardly arched thickening. When the gasket 33 shown in FIG. 7 is mounted in the plate 21, the coupling element 30 of the gasket 33 is pressed into the expanded part 27 of the plate 21 by application of downwards pressure onto the pressure cushion 35. The configuration of the coupling element 30 with a superjacent pressure element 34 is particularly interesting if the gasket 33 is to be mounted mechanically in the gasket groove 26, but it also presents certain advantages from a production point of view in connection with the manufacture of the gasket 33.

FIG. 8 shows yet an alternative embodiment of a gasket that can be mounted in the plate 21 shown in FIG. 5.

Like the coupling element 30 on the gasket 33 shown in FIGS. 6 and 7, the coupling element 40 of this gasket 43 consists of a central flap 41 and two external flaps 42. In this embodiment the external flaps 42 are the ones that will, upon mounting on the heat exchanger plate 21, engage with the openings 28 formed at the external sides of the ridged tongues 29, each of these external flaps 42 being provided with an inwardly protruding portion. The configuration of the coupling element 40 of the gasket 43 thus corresponds, in principle, to the configuration of the coupling element 10 of the gasket 3 (FIG. 2), there merely being a longer distance between the external flaps 42 than between the protruding flaps 11.

The central flap 41 can be configured such that it fits tightly down between the ridged tongues 29 whereby it contributes to securing the gasket 43 when it is mounted on the plate 21. However, it may also have a width that is smaller than the distance between the ridged tongues 29 which means that it does not contribute to securing the gasket 43, or it can optionally be omitted altogether.

The invention has been described with reference to preferred embodiments shown in the drawing, but alternative embodiments that are within the scope of the invention are perceivable, however. For instance the coupling elements 10 and 40, respectively, of the gaskets (3) (FIG. 3) and 43 (FIG. 8) can be provided with a superjacent pressure element corresponding to the pressure element 34 shown in FIG. 7 to facilitate mounting on the heat exchanger plates 1 and 21, respectively.

The coupling elements 10, 30 and 40 of the gaskets are shown in the embodiments as protruding from the gaskets 3, 33 and 43 with rounded, soft contours that impart to the gasket certain advantageous features with regard to strength and production. However, nothing prevents the coupling elements from being configured in other ways.

What is claimed is:

1. A heat exchanger plate for use in combination with a gasket in a plate-type heat exchanger, said plate comprising a gasket groove formed by an indentation that extends through at least portion of the heat exchanger plate spaced from the periphery of the plate, a plurality of expanded groove portions disposed in substantially the same plane as said gasket groove at spaced intervals, a first ridged, tongue-like portion disposed in each of the expanded groove portions extending upwardly from the gasket groove, said first tongue-like portion formed by cutting and ridging of the heat exchanger plate to expose first and second openings on the respective sides of said first tongue-like portion substantially perpendicular to the longitudinal direction of the gasket groove, said gasket including a plurality of coupling elements, each of said coupling elements configured to be received in a respective one of said expanded groove portions and engaged by said first tongue-like portion.

2. A heat exchanger plate according to claim 1, further comprising a second ridged, tongue-like portions disposed at a distance from said first tongue-like portion in each of the expanded groove portions.

3. A heat exchanger plate according to claim 1, wherein said first tongue-like portion is provided centrally in each of the expanded portions; and wherein each of the coupling elements of the gasket comprises two protruding flaps configured for engagement within the first and second openings.

4. A heat exchanger plate according to claim 3, wherein the flaps on each of the coupling elements of the gasket extend partially into the first and second openings.

5. A heat exchanger plate according to claim 3, wherein the flaps on each of the coupling elements of the gasket extend marginally into the first and second openings.

6. A heat exchanger plate according to claim 3, wherein each of the coupling elements of the gasket is provided with a superjacent pressure element.

7. A heat exchanger plate according to claim 1, further comprising a second ridged, tongue-like portions spaced from said first tongue-like portion in each of the expanded groove portions, said second ridged tongue-like portion formed by cutting and ridging of the heat exchanger plate to expose third and fourth openings on the respective sides of said second tongue-like portion, said first opening and said third opening defining proximal, mutually facing openings; and wherein each of the coupling elements of the gasket comprises a protruding flap configured for engagement within the proximal, mutually facing openings.

8. A heat exchanger plate according to claim 7, wherein the flaps on the each of coupling elements of the gasket extend partially into the proximal, mutually facing openings.

9. A heat exchanger plate according to claim 7, wherein the flaps on each of the coupling elements of the gasket extend marginally into the proximal, mutually facing openings.

10. A heat exchanger plate according to claim 7, wherein the coupling element of the gasket is provided with a superjacent pressure element.

11. A heat exchanger plate according to claim 1, further comprising a second ridged, tongue-like portions spaced from said first tongue-like portion in each of the expanded groove portions, said second ridged tongue-like portion formed by cutting and ridging of the heat exchanger plate to expose third and fourth openings on the respective sides of said second tongue-like portion, said second openings and said fourth opening defining opposed, distal openings; and wherein each of the coupling elements of the gasket comprises two outwardly protruding flaps that are configured for engagement within the opposed distal openings.

12. A heat exchanger plate according to claim 11, wherein the flaps on each of the coupling elements of the gasket extend partially into the opposed distal openings.

13. A heat exchanger plate according to claim 11, wherein the flaps on each of the coupling elements of the gasket extend marginally into the opposed distal openings.

14. A heat exchanger plate according to claim 11, wherein each of the coupling elements of the gasket is provided with a superjacent pressure element.

15. A heat exchanger plate according to claim 1, wherein each of the coupling elements of the gasket is provided with a superjacent pressure element.

16. A heat exchanger plate for use in combination with a gasket in a plate-type heat exchanger, said plate comprising a gasket groove formed by an indentation that extends through at least portion of the heat exchanger plate spaced from the periphery of the plate, a plurality of expanded groove portions disposed in substantially the same plane as said gasket groove at spaced intervals, a first ridged, tongue-like portion disposed in each of the expanded groove portions extending upwardly from the gasket groove, said first tongue-like portion formed by cutting and ridging of the heat exchanger plate to expose first and second openings on the respective sides of said first tongue-like portion substantially perpendicular to the longitudinal direction of the gasket groove, said gasket including a plurality of coupling elements, each of said coupling elements configured to be received in a respective one of said expanded groove portions and including protruding flaps that are engaged within said first and second openings by said first tongue-like portion.

17. A heat exchanger plate according to claim 16, wherein the flaps on the coupling element of the gasket extend partially into the first and second openings.

18. A heat exchanger plate according to claim 17, wherein each of the coupling elements of the gasket is provided with a superjacent pressure element.

19. A heat exchanger plate according to claim 16, wherein the flaps on each of the coupling elements of the gasket extend marginally into the first and second openings.

20. A heat exchanger plate according to claim 19, wherein each of the coupling elements of the gasket is provided with a superjacent pressure element.

* * * * *